US008409418B2

(12) United States Patent
Aksu et al.

(10) Patent No.: US 8,409,418 B2
(45) Date of Patent: Apr. 2, 2013

(54) ENHANCED PLATING CHEMISTRIES AND METHODS FOR PREPARATION OF GROUP IBIIIAVIA THIN FILM SOLAR CELL ABSORBERS

(75) Inventors: Serdar Aksu, San Jose, CA (US); Jiaxiong Wang, Castro Valley, CA (US); Mustafa Pinarbasi, Morgan Hill, CA (US)

(73) Assignee: SoloPower, Inc., San Jose, CA (US)

( * ) Notice: Subject to any disclaimer, the term of this patent is extended or adjusted under 35 U.S.C. 154(b) by 390 days.

(21) Appl. No.: 12/642,709

(22) Filed: Dec. 18, 2009

(65) Prior Publication Data

US 2010/0200050 A1 Aug. 12, 2010

Related U.S. Application Data

(63) Continuation-in-part of application No. 12/371,546, filed on Feb. 13, 2009, now Pat. No. 7,892,413.

(60) Provisional application No. 61/150,721, filed on Feb. 6, 2009.

(51) Int. Cl.
*C25D 5/10* (2006.01)
*C25D 5/48* (2006.01)
*C25D 5/50* (2006.01)

(52) U.S. Cl. ..... 205/220; 205/170; 205/176; 205/224; 205/228

(58) Field of Classification Search ..... 205/170, 205/176, 220, 224, 228
See application file for complete search history.

(56) References Cited

U.S. PATENT DOCUMENTS

| | | | | |
|---|---|---|---|---|
| 3,032,890 | A | 5/1962 | Brick et al. | |
| 4,450,786 | A | 5/1984 | Doehler et al. | |
| 4,492,181 | A | 1/1985 | Ovshinsky et al. | |
| 4,581,108 | A | 4/1986 | Kapur | |
| 4,723,507 | A | 2/1988 | Ovshinsky et al. | |
| 5,378,639 | A | 1/1995 | Sasaki et al. | |
| 5,441,897 | A | 8/1995 | Noufi et al. | |
| 5,571,749 | A | 11/1996 | Matsuda | 437/113 |
| 5,871,630 | A | 2/1999 | Bhattacharya et al. | |
| 6,602,440 | B2 | 8/2003 | Bishop et al. | 252/79.1 |
| 7,026,258 | B2 | 4/2006 | Taunier et al. | |
| 7,297,868 | B2 | 11/2007 | Bhattacharya | 136/262 |

(Continued)

FOREIGN PATENT DOCUMENTS

| | | | |
|---|---|---|---|
| CN | 101079454 A | * | 11/2007 |
| EP | 0782176 | | 7/1997 |

(Continued)

OTHER PUBLICATIONS

Massaccesi et al., "Cathodic Deposition of Copper Selenide Films on Tin Oxide in Sulfate Solutions", J. Electrochem. Soc. (Sep. 1993), vol. 140, No. 9, pp. 2540-2546.*

(Continued)

*Primary Examiner* — Edna Wong
(74) *Attorney, Agent, or Firm* — Pillsbury Winthrop Shaw Pittman LLP

(57) ABSTRACT

The present invention provides a method and precursor structure to form a Group IBIIIAIVA solar cell absorber layer. The method includes forming a Group IBIIIAVIA compound layer on a base by forming a precursor layer on the base through electrodepositing three different films, and then reacting the precursor layer with selenium to form the Group IBIIIAVIA compound layer on the base. The three films, described by the precursor layer, include in one embodiment a first alloy film comprising copper, indium and gallium, a second alloy film comprising copper and selenium formed on the first alloy film; and a selenium film formed on the second alloy film.

18 Claims, 2 Drawing Sheets

U.S. PATENT DOCUMENTS

| | | | | |
|---|---|---|---|---|
| 2004/0063320 | A1 | 4/2004 | Hollars | 438/689 |
| 2004/0161533 | A1 | 8/2004 | Sawayama et al. | |
| 2007/0093006 | A1 | 4/2007 | Basol | |
| 2007/0111367 | A1 | 5/2007 | Basol | |
| 2007/0116893 | A1 | 5/2007 | Zwaap et al. | 427/587 |
| 2007/0272558 | A1 | 11/2007 | Aksu et al. | 205/239 |
| 2008/0057616 | A1 | 3/2008 | Robinson et al. | |
| 2008/0169025 | A1 * | 7/2008 | Basol et al. | 136/262 |
| 2009/0283414 | A1 | 11/2009 | Wang et al. | |

FOREIGN PATENT DOCUMENTS

| | | |
|---|---|---|
| JP | 4-080371 | 3/1992 |
| JP | 6-204536 | 7/1994 |
| JP | 7-235504 | 9/1995 |
| JP | 11-135811 | 5/1999 |
| JP | 11-1145060 | 5/1999 |

OTHER PUBLICATIONS

European Search Report issued Dec. 15, 2010 in European Patent app No. 09708293.

International Search Report issued Feb. 18, 2011 in corresponding PCT/US2010/60704.

International Search Report issued Feb. 18, 2011 in corresponding PCT/US2010/60712.

Babu, et al., "Composition and Growth procedure-Dependent Properties of Electrodeposited CuInSe2 Thin Films", *Journal of Crystal Growth*, vol. 275, 2008, pp. e1241-e1246.

Basol, et al., "Electroplating Based CIGS Technology for Roll to Roll Manufacturing", *Proc. 23rd European PVSEC*, 2008, p. 2173.

Fritz, et al, "A New Electrochemical Method for Selenization of Stacked CuIn Layers and Preparation of CuInSe2 by Thermal Annealing", *Thin Solid Films*, vol. 247, 1994, pp. 129-133.

Ganchev, et al., "Preparation of Cu(In,Ga)Se2 Layers by Selenization of Electrodeposited Cu-In-Ga Precursors", *Thin Solid Films*, vol. 511-512, 2006, pp. 325-327.

Sene, et al., "Electrodeposition of CuInSe2 Absorber Layers from pH Buffered and Non Buffered Sulfate Based Solutions", *Thin Solid Films*, vol. 516, 2008, pp. 2188-2194.

European Search Report issed May 19, 2011 in European Patent app No. 07872342.

European Search Report issued May 11, 2012 in European Patent app No. 10739244.

Ganchev, et al., "Preparation of Cu(In,Ga)Se2 Layers by Selenization of Electrodeposited Cu-In-Ga Precursors", Thin Solid Films, vol. 511-512, Jul. 26, 2006, pp. 325-327.

Aksu, et al., "Electrodeposition of In-Se and Ga-Se Thin Films for Preparation of CIGS Solar Cells", Electrochemical and Solid State Letters, vol. 12, No. 5, Jan. 1, 2009, pp. D33-D35.

Aksu, et al., "Electrodeposition of In-Se and Ga-Se Thin Films for Preparation of CIGS Solar Cells", Electrochem. And Solid State Letters, 12(5), 2009, pp. D33-D35.

* cited by examiner

ENHANCED PLATING CHEMISTRIES AND METHODS FOR PREPARATION OF GROUP IBIIIAVIA THIN FILM SOLAR CELL ABSORBERS

CROSS REFERENCE TO RELATED APPLICATIONS

This application is a continuation-in-part of U.S. Ser. No. 12/371,546 filed Feb. 13, 2009 entitled "ELECTROPLATING METHODS AND CHEMISTRIES FOR DEPOSITION OF COPPER-INDIUM-GALLIUM CONTAINING THIN FILMS" now U.S. Pat. No. 7,892,413, which claims benefit to U.S. Ser. No. 61/150,721 filed on Feb. 6, 2009.

FIELD OF THE INVENTION

The present invention relates to electroplating chemistries and methods for preparing semiconductor thin films for photovoltaic applications, specifically to plating electrolytes and methods for the processing Group IBIIIAVIA compound layers for thin film solar cells.

BACKGROUND

Solar cells are photovoltaic devices that convert sunlight directly into electrical power. The most common solar cell material is silicon, which can be used in the form of single or polycrystalline wafers. However, the cost of electricity generated using silicon-based solar cells is higher than the cost of electricity generated by the more traditional methods. Therefore, since early 1970's there has been an effort to reduce cost of solar cells for terrestrial use. One way of reducing the cost of solar cells is to develop low-cost thin film growth techniques that can deposit solar-cell-quality absorber materials on large area substrates and to fabricate these devices using high-throughput, low-cost methods.

Group IBIIIAVIA compound semiconductors comprising some of the Group IB such as (Cu), silver (Ag), gold (Au), Group IIIA such as boron (B), aluminum (Al), gallium (Ga), indium (In), and thallium (Tl), and Group VIA such as oxygen (O), sulfur (S), selenium (Se), tellurium (Te), and polonium (Po) materials or elements of the periodic table are excellent absorber materials for thin film solar cell structures. Especially, compounds of Cu, In, Ga, Se and S which are generally referred to as CIGS(S), or $Cu(In,Ga)(S,Se)_2$ or $CuIn_{1-x}Ga_x(S_ySe_{1-y})_k$, where $0 \leqq x \leqq 1$, $0 \leqq y \leqq 1$ and k is approximately 2, have already been employed in solar cell structures that yielded conversion efficiencies approaching 20%. Absorbers containing Group IIIA element Al and/or Group VIA element Te also showed promise. Therefore, in summary, compounds containing: i) Cu from Group IB, ii) at least one of In, Ga, and Al from Group IIIA, and iii) at least one of S, Se, and Te from Group VIA, are of great interest for solar cell applications. Among these compounds, Cu (In,Ga) $(S,Se)_2$ is the most advanced and solar cells in the 12-20% efficiency range have been demonstrated using this material as the absorber. Aluminum containing chalcopyrites such as $Cu(In,Al)Se_2$ layers have also yielded over 12% efficient solar cells.

The structure of a conventional Group IBIIIAVIA compound photovoltaic cell such as a $Cu(In,Ga,Al)(S,Se,Te)_2$ thin film solar cell is shown in FIG. 1. The device 10 is fabricated on a substrate 11, such as a sheet of glass, a sheet of metal, an insulating foil or web, or a conductive foil or web. The absorber film 12, which includes a material in the family of $Cu(In,Ga,Al)(S,Se,Te)_2$, is grown over a conductive layer 13 or contact layer, which is previously deposited on the substrate 11 and which acts as the electrical contact to the device. The substrate 11 and the conductive layer 13 form a base 13A (not shown) on which the absorber film 12 is formed. Various conductive layers comprising molybdenum (Mo), tantalum (Ta), tungsten (W), titanium (Ti), stainless steel and the like have been used in the solar cell structure of FIG. 1. If the substrate itself is a properly selected conductive material, it is possible not to use the conductive layer 13, since the substrate 11 may then be used as the ohmic contact to the device. After the absorber film 12 is grown, a transparent layer 14 such as a cadmium sulfide (CdS), zinc oxide (ZnO) or CdS/ZnO stack is formed on the absorber film. Radiation 15 enters the device through the transparent layer 14. Metallic grids (not shown) may also be deposited over the transparent layer 14 to reduce the effective series resistance of the device. The preferred electrical type of the absorber film 12 is p-type, and the preferred electrical type of the transparent layer 14 is n-type. However, an n-type absorber and a p-type window layer can also be utilized. The preferred device structure of FIG. 1 is called a "substrate-type" structure. A "superstrate-type" structure can also be constructed by depositing a transparent conductive layer on a transparent superstrate such as glass or transparent polymeric foil, and then depositing the $Cu(In,Ga,Al)(S,Se,Te)_2$ absorber film, and finally forming an ohmic contact to the device by a conductive layer. In this superstrate structure light enters the device from the transparent superstrate side. A variety of materials, deposited by a variety of methods, can be used to provide the various layers of the device shown in FIG. 1.

In a thin film solar cell employing a Group IBIIIAVIA compound absorber, the cell efficiency is a strong function of the molar ratio of IB/IIIA. If there are more than one Group IIIA materials in the composition, the relative amounts or molar ratios of these IIIA elements also affect the properties. For a $Cu(In,Ga)(S,Se)_2$ absorber layer, for example, the efficiency of the device is a function of the molar ratio of Cu/(In+Ga). Furthermore, some of the important parameters of the cell, such as its open circuit voltage, short circuit current and fill factor vary with the molar ratio of the IIIA elements, i.e. the Ga/(Ga+In) molar ratio. In general, for good device performance Cu/(In+Ga) molar ratio is kept at around or below 1.0. As the Ga/(Ga+In) molar ratio increases, on the other hand, the optical bandgap of the absorber layer increases and therefore the open circuit voltage of the solar cell increases while the short circuit current typically may decrease. It is important for a thin film deposition process to have the capability of controlling both the molar ratio of IB/IIIA, and the molar ratios of the Group IIIA components in the composition. It should be noted that although the chemical formula is often written as $Cu(In,Ga)(S,Se)_2$, a more accurate formula for the compound is $Cu(In,Ga)(S,Se)_k$, where k value is 2, although it is typically close to 2 but may not be exactly 2. It should be further noted that the notation "Cu(X,Y)" in the chemical formula means all chemical compositions of X and Y from (X=0% and Y=100%) to (X=100% and Y=0%). For example, Cu(In,Ga) means all compositions from CuIn to CuGa. Similarly, $Cu(In,Ga)(S,Se)_2$ means the whole family of compounds with Ga/(Ga+In) molar ratio varying from 0 to 1, and Se/(Se+S) molar ratio varying from 0 to 1.

If there is more than one Group VIA material or element in the compound, the electronic and optical properties of the Group IBIIIAVIA compound are also a function of the relative amounts of the Group VIA elements. For $Cu(In,Ga)(S,Se)_2$, for example, compound properties, such as resistivity, optical bandgap, minority carrier lifetime, mobility etc., depend on the Se/(S+Se) ratio as well as the previously mentioned Cu/(In+Ga) and Ga/(Ga+In) molar ratios. Consequently, solar-to-electricity conversion efficiency of a CIGS (S)-based solar cell depends on the distribution profiles of Cu, In, Ga, Se and S through the thickness of the CIGS(S) absorber.

In the fabrication of CIGS films, various manufacturing techniques involving evaporation, sputtering or electrodeposition are used. Evaporation is an expensive technique and non-uniformity problems over large surface areas preset difficulties. Although the sputtering can be applies over large surface areas, it requires expensive systems and sputtering targets. Electrodeposition offers a low-cost alternative for depositing CIGS precursor films in a high-volume manufacturing environment. Electrodeposition is a versatile deposition method with ability to yield thin films of metals, metal alloys and compounds which may be used in a wide variety of precursor layer structures. Electrodeposition equipment is low cost and the process is energy efficient since it is typically carried out at low temperatures. Materials utilization in electrodeposition processes can be close to 100% if stable electrolytes with long lifetime are employed. Electrodeposition is also suitable for high throughput roll to roll manufacturing.

One prior art approach to form CIS and CIGS precursors by electrodeposition is to form stacks consisted of individual elemental layers. Precursor stacks such as Cu/In, Cu/In/Se, Cu/In/Ga, and Cu/In/Ga/Se stacks can be electrodeposited on Mo coated substrates to form Mo/CIS and Mo/CIGS structures and subsequently annealed in inert or Se containing environments to manufacture CIS and CIGS absorber layers. For example, U.S. Pat. No. 4,581,108 describes a low cost electrodeposition method to prepare a metallic precursor preparation. In this method a Cu/In stack is first formed by electrodeposition on a substrate and the stack is heated in a reactive atmosphere containing Se to form a CIS absorber layer. Similarly, Fritz et al. used electrodeposition to form a Cu/In/Se stack on a substrate and a following rapid thermal annealing of the stack to form CIS [Fritz et al., *Thin Solid Films* 247 (1994) 129]. In another prior art approach developed at SoloPower Inc., a Cu/In/Ga/Se precursor stack is first electrodeposited and converted to CIGS absorber by a subsequent rapid thermal processing step [Basol et al., *Proc.* 23*rd European PVSEC,* 2008, p. 2137]. One of the reasons for selecting Cu/In and Cu/In/Ga electrodeposition sequence is the fact that Cu, In and Ga can have very different standard plating potentials. The standard electrode potentials of $Cu/Cu^{2+}$, $In/In^{3+}$ and $Ga/Ga^{3+}$ metal/ion couples in aqueous solutions are about +0.337 V, −0.342 V, and −0.52 V, respectively. This means that Cu can be plated out at low negative voltages. For In deposition, on the other hand, larger negative voltages are needed. For Ga deposition, which is challenging due to hydrogen evolution, even larger negative voltages are required. Therefore, to form a stack including Cu, In and Ga, Cu was typically electroplated first. This was then followed by deposition of In and then Ga so that while plating the second metal over the first metal, the first metal does not dissolve into the electrolyte of the second metal. Therefore, prior-art methods have employed Cu/In/Ga stacks electroplated in that order, which limits the way in which Cu, In and Ga is distributed through the thickness of the precursor film.

One step electrodeposition of CIS or CIGS precursor films from a single electrolyte is another prior art approach for utilizing electrodeposition for CIGS cell fabrication as described in U.S. Pat. No. 7,297,868. The precursor films plated from Cu—In—Ga—Se electroplating bath are subsequently subjected to a high temperature crystallization step to improve their photovoltaic properties. In this prior art, an acidic electrolyte with a pH of approximately 2 was used. The deposition bath used for the codeposition of Cu—In—Ga—Se by electrodeposition contained 0.02M $Cu(NO_3)_2.6H_2O$, 0.08M $InCl_3$, 0.024M $H_2SeO_3$, and 0.08M $Ga(NO_3)_3$ and 0.7M LiCl dissolved in de-ionized water. Similar acidic electrolytes for the co-deposition of CIS and CIGS precursors have been investigated by several other researchers. For example, Babu et al. electrodeposit $CuInSe_2$ from a sulphate bath containing 10 mM $CuSO_4$, 50 mM $In_2(SO_4)_3$ and 30 mM $SeO_2$ with a pH of 1.5 [Babu et al, *Journal of Crystal Growth* 275 (2005) e1241-e1246]. In another example, Sene et al. employ sulfate-based plating baths, containing $CuSO_4.5H_2O$, $In_2(SO_4)_3.H_2O$, $SeO_2$ and $Li_2SO_4.H_2O$ as a supporting electrolyte, dissolved in deionized water, prepared with and without pHydrion pH=3 buffer to deposit the CIS films. The pHydrion pH=3 is a mixture of sulfamic acid and potassium biphthalate. [Sene et al, *Thin Solid Films* 516 (2008) 2188-2194].

In such one-step cathodic electrodeposition processes, simultaneous reduction of all the constituent ions of Cu, In, Ga and Se at the same potential in suitable proportions is necessary in order to achieve the desired film composition. A common problem associated with electrodeposition from such single electrolytes is precipitations of metal oxide and hydroxide. In order to prevent this unwanted deposition, pH buffer and complexing agents are included in the electrolytes. However, even with this approach it is highly difficult to attenuate precipitation and deposition of hydroxides during film growth from acidic solutions. Metal concentrations in the electrolytes are kept in minimum to avoid this problem. While this can be an acceptable approach for studying the fundamentals of electroplating precursors in research scale, industrial large plating applications require plating baths with stable compositions which can be kept for several months.

Another major problem in the co-electrodeposition of Cu—In—Ga—Se from acidic electrolytes is generation of colloidal Se which is mostly produced near the cathode surface. These colloidal Se particles aggregate and become larger in size with time. As the plating continues, both the number and the size of red selenium particles increase in the electroplating solution. Some particles get trapped on the cathode surface and form defects in the deposited Se film in the form of particle inclusions. Such compositional differences between portions of the stack create morphological, electrical and compositional differences between corresponding portions of the compound CIGS layer obtained after the reaction step. This, in turn, reduces the CIGS layer's uniformity and thus reduce the efficiencies of solar cells fabricated on such non-uniform layers. One approach to minimize this problem is to use very slow deposition rates in the co-electrodeposition of CIGS. Deposition periods exceeding 45 minutes are not uncommon. For example, Sene et al. indicate that it took 90 minutes to obtain a approximately 2 μm thick CIS layer [Sene et al, *Thin Solid Films* 516 (2008) 2188-2194]. Obviously, such extremely low deposition rates are not appropriate for large scale manufacturing purposes such as roll to roll manufacturing.

Some of the problems described above can be avoided if selenium is excluded from the single step electrodeposition solution. A Cu—In—Ga electrolyte can be used to deposit only a ternary thin film layer of Cu—In—Ga as described by Ganchev et al., *Thin Solid Films* 511-512 (2006) 325-327. This Cu—In—Ga bath contained 50-100 mg cuprous chloride (CuCl), 100-350 mg indium chloride ($InCl_3$), 1700 mg gallium nitrate ($Ga(NO_3)_3.7H_2O$) and 2M potassium thiocyanate (KSCN) as a complex agent in 0.2 liter of de-ionized water. The pH=5 value of the solution was adjusted by 0.4 M acetate buffer. The publication indicates thiocyanate is used to shift the deposition potential of elemental copper to bring it closer to deposition potentials of Ga and In. It is noted that thiocyanate complexes of $In^{3+}$ and $Ga^{3+}$ are not as stable as cuprous complexes. As a result, $In^{3+}$ and $Ga^{3+}$ reduction potentials did not change noticeably. Since thiocyanate cannot form stable complexes with In and Ga ions at this pH, formation of indium and gallium oxides and hydroxides cannot be completely eliminated. Due probably to the instability issues, this prior art formulation for Cu—In—Ga electrolyte was extremely sensitive to the hydrodynamic regime of deposition as evident from the large changes in the Ga content with and without stirring during plating.

From the foregoing there is a need for better electrodeposition techniques to form various metallic precursor stacks comprising Cu, In, Ga and Se together.

SUMMARY

The present invention provides a method and precursor structure to form a Group IBIIIAIVA solar cell absorber layer.

In one aspect is described a method of forming a Group IBIIIAVIA compound layer on a base comprising: forming a precursor layer on the base, comprising: electrodepositing a first film on the base using a first electrodeposition solution, the first film comprising a copper-indium-gallium ternary alloy; electrodepositing a second film on the metallic film using a second electrodeposition solution, the second film comprising one of a copper-selenium alloy, an indium-selenium alloy and a gallium-selenium alloy; and electroplating a third film comprising selenium on the second film; and reacting the precursor layer with selenium thereby forming the Group IBIIIAVIA compound layer on the base.

In another aspect is described a precursor structure for forming a Group IBIIIAIVA solar cell absorber on a surface of a base, comprising: a first alloy film formed on the surface of the base, the first alloy film comprising copper, indium and gallium, wherein the thickness of the first alloy film is at least 50 nm; a second alloy film comprising copper and selenium formed on the first alloy film; and a selenium film formed on the second alloy film.

BRIEF DESCRIPTION OF THE DRAWINGS

These and other aspects and features of the present invention will become apparent to those of ordinary skill in the art upon review of the following description of specific embodiments of the invention in conjunction with the accompanying figures, wherein.

DETAILED DESCRIPTION

The present invention provides electrodeposition methods and electrodeposition solution used to deposit precursor layers for forming group IBIIIAIVA absorber layers such as $Cu(In,Ga)Se_2$ or CIGS layer to manufacture photovoltaic cells or solar cells. In a first embodiment, a Group IB-IIIA electrodeposition solution of the present invention may be utilized to electrodeposit an alloy film comprising at least three ingredients, such as Cu, In and Ga, of a $Cu(In,Ga)Se_2$ layer onto substrates.

Figure 1:
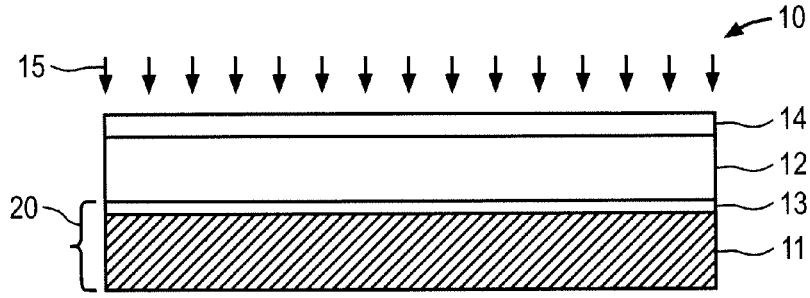
FIG. 1 is a cross-sectional view of a solar cell employing a Group IBIIIAVIA absorber layer.
Figure 2:
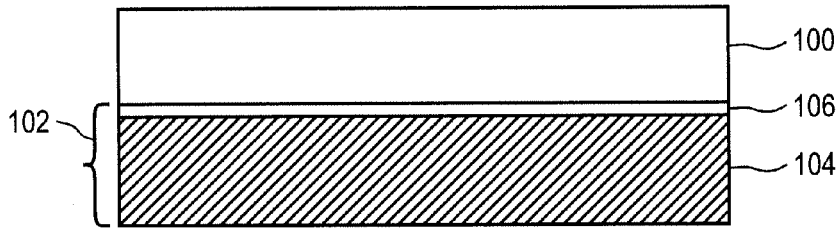
FIG. 2 is a schematic view of an alloy film electrodeposited from an electrodeposition solution of the present invention.

FIG. 2 shows a metallic film 100 or alloy film electrodeposited from the electrodeposition solution of the present invention over a base 102 including a substrate 104 and a contact layer 106 formed over the substrate. The metallic film 100 is a ternary Cu—In—Ga alloy film, which includes all the metallic components, i.e., Cu, In and Ga, of a CIGS precursor in a continuous matrix. The electrodeposition process is carried out in a deposition station where the contact layer (cathode) and an anode are wetted by the electrodeposition solution. When electroplating potential applied between an anode and the contact layer 10, the metallic film is electrodeposited onto the contact layer. Principles of the electrodeposition process are well known and will not be repeated here for the sake of clarity.

When reacted with a Group VIA material, the metallic film 100 forms A CIGS absorber layer of a solar cell. As will be described more fully below, Cu, In and Ga elements may also be graded through the thickness of the Cu—In—Ga ternary alloy film. The contact layer 106 may be made of a molybdenum (Mo) layer deposited over the substrate 104 or a multiple layers of metals stacked on a Mo layer; for example, molybdenum and ruthenium multilayer (Mo/Ru), or molybdenum, ruthenium and copper multilayer (Mo/Ru/Cu). To form a contact layer having multi layers, for example, Ru layer may be electrodeposited on the Mo layer, and similarly the Cu layer may be electrodeposited on the Ru layer to form the contact layer. The substrate 104 may be a flexible substrate, for example a stainless steel foil, or a aluminum foil, or a polymer. The substrate may also be a rigid and transparent substrate such as glass.

The electrodeposition solution of the present invention is a copper indium gallium ternary alloy electrodeposition electrolyte and may comprise a solution prepared by dissolving Cu, In and Ga metals into their ionic forms as well as by dissolving soluble Cu, In and Ga salts, such as sulfates, chlorides, acetates, sulfamates, carbonates, nitrates, phosphates, oxides, perchlorates, and hydroxides and other salts of these elements in predetermined amounts. Molar amounts of Cu, In and Ga ions in the electrodeposition solution might be adjusted according to preferred composition of the final desired precursor film. The concentration range for dissolved Cu in the electrodeposition solution may be between 0.005 and 0.5 mol/liters, and preferably between 0.01 and 0.25 mol/liters. The concentration range for dissolved Ga in the electrolyte may be 0.01 and 0.7 mol/liters, and preferably between 0.05 and 0.35 mol/liters. The concentration range for dissolved In in the electrodeposition solution may be 0.01 and 0.7 mol/liters, and preferably between 0.05 and 0.35 mol/liters.

In this embodiment, the electrodeposition solution of the present invention is formulated at the alkaline pH regime or high pH regime, where pH is greater than 9, or between 9 and 14, by incorporating complexing agents. In the alkaline pH regime, a complete deprotonation of the complexing agents may be made available. The electrodeposition solution can be prepared using at least one complexing agent selected from the group of organic complexing agents including amine and carboxylic groups. Common examples for these complexing agents may be citric acid, tartaric acid, ethylenediamine, triethanolamine, glycine, and ethylenediaminetetraacetic acid etc. If only one complexing agent is used, then an appropriate complexing agent that can form soluble complexes with both Cu, In and Ga should be selected.

In this embodiment, more than one complexing agents may be used in the electrodeposition solution as a blend of complexing agents. In this blend, each complexing agent can selectively complex each of the dissolved In Ga and Cu ions and bring plating potentials of these three metals to desired levels. For example, tartaric acid is a good complexing agent for indium in the alkaline pH regime because it provides tartrate ions which can form soluble indium tartrate species. On the other hand, citric acid is a very suitable complexing agent for Ga in the alkaline pH regime since it provides citrate ions which can form soluble gallium citrate species. Both tartrate and citrate ions also complex copper ions in the alkaline pH regime. If more complexation of Cu is needed, for example, ethylenediaminetetraacetic acid (EDTA) may also be included in the formulation. EDTA may form stronger soluble complexes with Cu ions compared to In and Ga ions.

With the assistance of these complexing agents, electrodeposition potentials of Cu, Ga and In could be modified to allow electrodeposition of Cu—In—Ga ternary alloy metallic films. Optionally, tartaric acid may be substituted with alkali and alkali earth metal salts of tartaric acid, such as sodium tartrate, potassium tartrate, calcium tartrate, magnesium tartrate and the like. These optional chemicals may also be used as a source of tartrate ions in the electrodeposition solution of the present invention. Optionally, citric acid may be substituted with alkali and alkali earth metal salts of citric acid, such as sodium citrate, potassium citrate, calcium citrate, magnesium citrate or the like, which may also be used as a source of citrate ions in the electrodeposition solution of the present invention. EDTA may also be substituted with alkali and alkali earth metal salts of EDTA such as disodium EDTA salt, dipotassium EDTA salt, EDTA calcium derivative disodium salt and EDTA magnesium derivative disodium salt, which may also be used as a source of ethylenediaminetetraacetate ions. An example IB-IIIA solution is also disclosed in U.S. patent application Ser No. 12/371,546 filed on Feb. 13, 2009, entitled "Electroplating Methods and Chemistries for Deposition of Copper Indium Gallium Containing Thin Films" now U.S. Pat. No. 7,892,413, which is assigned to the assignee of the present application, and which is incorporated herein by reference in its entirety.

As described above, the electrodeposition solutions described in this invention operate at alkaline pH regime. In the alkaline regime, complexing agents included in the electrodeposition solution of the present invention are most active to form soluble metal complex species with Cu, Ga and In ions. This opposes to the use of complexing agents in the prior art electrolytes which are typically utilized to electrodeposit in the acidic regime (pH is less than 9). However, each of the such complexing agents are inactive due to the formation and predomination of protonated complex species. For example in a prior art electrodeposition solution prepared with citric acid, at pH=2, only 0.00000014% of all citric acid is in the form of completely deprotonated citrate form. At pH=5, the percentage of completely deprotonated citrate is merely about 0.73%. Fully deprotonated percentage increases to about 53.53% at pH=7, and to 99.14% at pH=9. Since deprotonated forms of complexing agents are very effective in forming soluble metal complexes, the alkaline pH regime is the most suitable for the Cu—In—Ga electrodeposition solution of the present invention. The complexing agents are almost fully deprotonated and form soluble metal-complex ions with Cu, Ga and In ions when the pH of the electrodeposition solution of the present invention is maintained at a value greater than 9. The more preferable pH range in this invention is between 10 and 12.5. Use of multiple complexing agents at high pH regime allows dissolving large enough molar amounts of Cu, In and Ga into the solution suitable for large scale CIGS manufacturing plating lines.

In a second embodiment of the present invention, electrodeposition potential or current density may be varied to distribute each of Cu, In and Ga according to predetermined profiles through the thickness of the first layer, as the Cu, In and Ga are electrodeposited from the electrodeposition solution of the present invention. The molar rations of Cu, In and Ga in the deposited metallic films are changed or distributed within a predetermined distribution profile to provide preferred reaction kinetics when the metallic film is reacted with a Group VIA material, such as Se and/or S to form a CIGS absorber.

Figure 3:
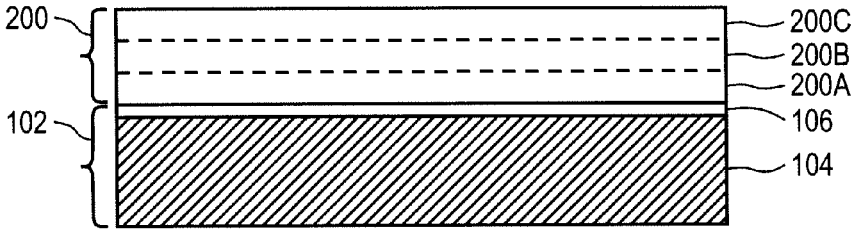
FIG. 3 is a schematic view of another alloy film electrodeposited from an electrodeposition solution of the present invention.

FIG. 3 shows a metallic film 200, which is a Cu—In—Ga ternary alloy metallic film, electrodeposited onto the base 102 from the electrodeposition solution of the present invention. As exemplified in FIG. 3, a first portion 200A or bottom portion of the metallic film 200 may be formed over the contact layer 106 with a composition that is high in Cu at the beginning of the electrodeposition process. On the other hand, as a predetermined thickness is approached, more In and Ga may be incorporated from the electrodeposition solution to form a second portion 200B or intermediate portion of the metallic film 200 on the first portion by adjusting the electrodeposition potential. Finally, a third portion 200C or top portion of the metallic film 200 is formed on the second portion with a composition that is low in Cu.

This embodiment takes the advantage of the differences in the standard plating potentials of Cu, Ga and In. During the electrodeposition process, Cu electrodeposition may be encouraged by applying low plating potentials or current densities as noted above to produce the first portion 200A. Therefore, at low plating potentials or current densities, the first portion 200A of the metallic film will be rich in Cu. As the plating potential or current density is increased, more In and Ga will be incorporated into the film from the electrodeposition solution to form the second portion 200B of the metallic film. The third portion 200C of the metallic film 200 grows under high electrodeposition potential with a low Cu amount high in In and Ga. The metallic films, which are produced this way, would be very beneficial to regulate the desirable reaction pathways in formation of CIGS absorber layer. After electrodepositing the metallic film 100 or 200, a Group VIA material layer may be deposited onto the metallic film comprising Cu, In and Ga to form a precursor layer. The Group VIA material is preferably selenium and may be electrodeposited over the metallic film from another electrodeposition solution. The exclusion of Se in the Cu—Ga—In ternary electroplating solution of the present invention provides several advantages. First, it allows utilization of high deposition rates for Cu—In—Ga layers. In fact, a large range of deposition current densities from 1 mA/cm$^2$ to 60 mA/cm$^2$ can be used for the Cu—Ga—In ternary electroplating solution of the present invention. More preferable current density range of electrodeposition is between 10 to 40 60 mA/cm$^2$. Second advantage is that the film composition, morphology and the electrical conductivity and defectivity can be much better controlled when Se is excluded. Electrodeposition of subsequent thin film layers with minimal defectivity is possible over a high quality Cu—In—Ga thin layer.

A third embodiment of the present invention provides a two step process including a first step to electrodeposit a copper, indium and gallium metallic film on the base and a second step to electrodeposit a supplementary film including a binary alloy having at least one of Cu—Se alloy, In—Se alloy and Ga—Se alloy on the metallic film. If the supplementary film is a Cu—Se film, it may induce formation of copper selenide at the very beginning of the subsequent reaction step to form the absorber. The most of the Cu needed in the formation of a solar cell absorber may be included in the supplementary film deposited over the metallic film. For example a minimum 60% molar amount of all the copper needed for the final absorber may be in the supplementary film. An additional step of the process may comprise depositing a Group VIA material such as substantially pure selenium over the supplementary film before reacting the precursors stack to form a CIGS absorber layer.

Figure 4A:
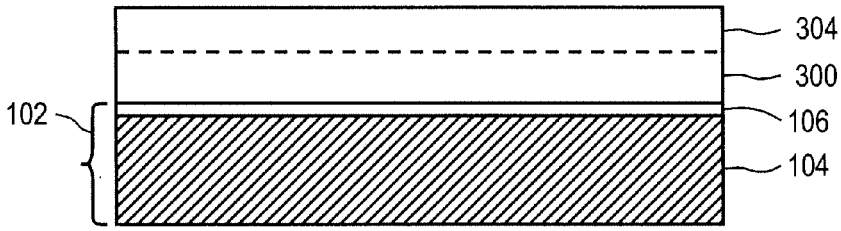
FIG. 4A is a schematic view of a structure including a metallic layer and a supplementary layer.

FIG. 4A shows a first film 300 formed over the base 102. The first film 100 is a metallic film including a copper, indium and gallium ternary alloy (Cu—In—Ga alloy). Preferably, the molar amount of copper is less than 20% of the molar amount of copper in the final CIGS layer. Cu and other molar amounts depend on the optimal values of Cu/(Ga+In) and Ga/(Ga+In) in the final CIGS absorbers. In this embodiment, the first film 300 is deposited over the contact layer 106 using, preferably, the electrodeposition solution described above. As described, the electrodeposition solution includes salts of Cu, In and Ga, one or more complexing agents and a high pH value. Ratios of these elements may be reformulated with predetermined amounts to form the first layer 300. For example: In an alloy plating bath containing tartrates, a preferred electrodeposition current density may be in the range of 2.5 and 40 mA/cm$^2$. This current density may be varied during the electrodeposition process so as to control the vertical distribution of Cu, In and Ga through the thickness of the first film 300 as described in the previous embodiment. By distributing Cu, In and Ga such way, it is possible to form a graded composition profile in the first film 300. An exemplary first layer thickness may be in the range of 100-900 nm, and preferably 300-700 nm.

As also shown in FIG. 4A, in the following step of the process, a second film 304 is deposited onto the first film 300 from, preferably, a second electrodeposition solution. The second film 304 may be a binary alloy including one of copper-selenium (Cu—Se) alloy, indium-selenium (In—Se) alloy and gallium-selenium (Ga—Se) alloy. In this embodiment, if the first film 300 is made copper poor, the second film may be a Cu—Se alloy, and the second electrodeposition solution includes a Cu salt, a Se source such as a selenious acid and organic acid additives which can solubilize Cu at a low pH regime. A preferred pH range may be 0-3. Contrary to the possible poor Cu content of the first film 300, the second film 304 may be Cu rich and includes the most of the copper needed to form the final CIGS absorber layer. For example, a minimum 60% molar amount of all the copper needed for the final absorber may be in the second film 304. Thickness of the second film is in the range of 50 to 800 nm.

Figure 4B:
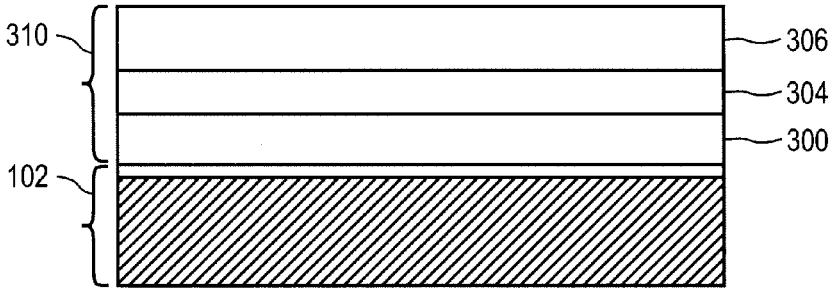
FIG. 4B is a schematic view of a precursor structure including the structure shown in FIG. 4A.

As shown in FIG. 4B, in the next process step, a third film 306, including a Group VIA material, is deposited onto the second film 304 to complete a precursor layer or stack 310. The Group VIA material is preferably selenium and electrodeposited over the second layer 304 from a third electrodeposition solution including selenium. Of course, the precursor stack 310 can also be formed with the metallic films described in the previous embodiments.

Figure 5:
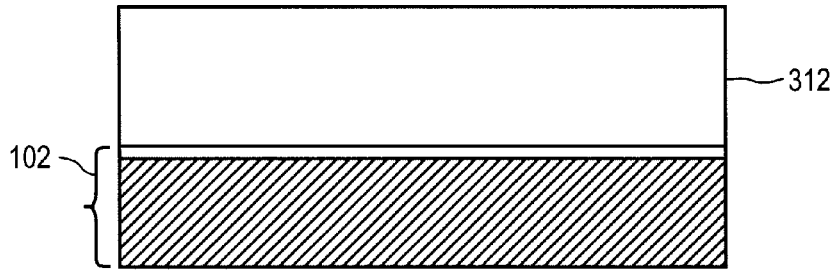
FIG. 5 is a schematic view of an absorber of the present invention formed on a base.

As shown in FIG. 5, a next stage of the process involves heat treatment and reaction needed to convert the precursor layer 310 into an absorber layer 312 or Group IBIIIAVIA compound layer. Typically, the reaction step may involve heating the precursor film to a temperature range of 400-600° C., optionally in the presence of Se provided by sources such as solid or liquid Se, $H_2Se$ gas, organometallic Se vapor sources, elemental Se vapors, and the like, for periods ranging from 1 minute to 30 minutes. The heating rate from room temperature to the process or reaction temperature may be in the range of 1-50° C./seconds, preferably in the range of 5-20° C./seconds. In addition to Se or in place of Se, sulfur (S) and Na-doping compounds such as NaF may also be provided to the film during this reaction step. If the precursor film comprises excess amount of Se in addition to Cu, In and Ga, the annealing or the reaction step may be carried out in an inert atmosphere. In case Se vapor is used during reaction, the Se vapor may be generated by heating solid or liquid Se sources or by applying organometallic Se sources among others.

The method is also applicable to roll-to-roll plating of the metallic films. In roll-to-roll scheme, segmented anodes in the same plating bath could be used. The applied voltage or the current at each anode segment could be controlled individually. By applying different voltages or currents to the segments, the composition of the alloy film deposited on the substrate roll (cathode) could be changed, while substrate is moving relative to the segmented anodes.

The invention will now be further described using specific examples.

Example 1

Dependency of Cu—In—Ga Alloy Compositions Upon Current Densities

The solution used in this example contained 0.1 M $InCl_3$, 0.09 M $GaCl_3$, 0.065 M $CuSO_4$ in 1.0 M potassium sodium tartrate with a pH value of 10.5. Compositions of the resultant alloy films depend on the current densities applied in the plating. At a low current density, almost no Ga was plated into the films. At 5 mA/cm$^2$ for 80 seconds, for instance, the plated alloy film had a total thickness about 150 nm with a composition of 17 atomic percent In, and about 83% of Cu and negligible amount of Ga, which could be represented with a formula of $Cu_5In$. When the current density was increased to 20 mA/cm$^2$, the plated film possesses a composition with a formula of $Cu_3In_2Ga$ with a thickness about 150 nm after a 20 second deposition period. Under a high current density such as 40 mA/cm$^2$, the plated film gives rise to a formula of $Cu_5In_3Ga_3$ and a total thickness about 150 nm during a period of 10 seconds. In spite of different current densities, the same amount of total plating charge was applied in all of these three cases. They produce almost the same total thickness with various compositions. This suggests that the cathodic current efficiencies during the plating do not change much with incorporation of Ga into the films. The examinations of Scanning Electron Microscopy (SEM) and Energy Dispersive Spectroscopy (EDS) indicated that all the films had an even and smooth surface morphology and uniformly distributed surface compositions.

Example 2

Ga Rich Cu—In—Ga Alloy Films

Due to a very low reduction potential, Ga is more difficult to be plated into the Cu—In—Ga alloy films. Although the Ga content can be increased with a high current density as described in Example 1, it is also possible to increase the concentration of Ga salt in the plating solution to incorporate more Ga into the film. We formulated a solution containing 0.065 M $InCl_3$, 0.12 M $GaCl_3$, 0.06 M $CuSO_4$ in 1.0 M potassium sodium tartrate with a pH value of 10.5 to produce Ga rich Cu—In—Ga films. From this electrolyte, we plated films with a formula of $Cu_{2.2}InGa_2$ and a total thickness about 140 nm in a plating period of 10 seconds at a current density of 40 mA/cm$^2$. If the current density was dropped down to 20 mA/cm$^2$ for 20 seconds, however, a formula of the plated film changes to $CuIn_{0.43}Ga_{0.53}$ but the total thickness increases to about 155 nm with the same plating charge. In addition, all of the films show smooth and even surface morphology and uniform surface compositions Example 3

Increasing in Content in the Cu—In—Ga Alloy Films

As the same reason, the In content can be increased with a higher In concentration in the plating bath. As an example, a plating bath containing 0.135 M $InCl_3$, 0.06 M $GaCl_3$, 0.07 M $CuSO_4$ in 1.0 M potassium sodium tartrate with a pH value of 10.5 was used. The plating condition was 20 mA/cm$^2$ for 20 seconds. The resultant alloy film has a formula of $CuIn_{0.71}Ga_{0.42}$ with a total thickness about 146 nm. Also the resultant film possesses a smooth surface and uniformly distributed surface composition.

The Cu—In—Ga alloy thin film deposited using the plating solution of the present invention can be used for the preparation of CIGS solar absorbers in several different ways. In the simplest form, the precursor can be deposited in one single plating step using this solution. This precursor can be annealed at high temperate in a reactive $H_2Se$, $H_2S$ or Se environment to form the CIGS compound. Alternatively, a Se layer can be deposited over the Cu—In—Ga layer and then the precursor is annealed at high temperature in either in an inert or a reactive $H_2Se$, $H_2S$ or Se environment. The Cu—In—Ga alloy film can also be used as one of the layers in an electrodeposited multilayer stack of elemental and alloy layers. Several combinations are possible but following examples could be listed to illustrate the approach: Cu/Cu—In—Ga, Cu/Ga/Cu—In—Ga, Cu/In/Cu—In—Ga, Cu/Ga/Cu—In—Ga/Ga, Cu/In/Cu—In—Ga/Ga, Cu/Cu—In—Ga/Se, Cu/Ga/Cu—In—Ga/Se, Cu/In/Cu—In—Ga/Se, Cu/Ga/Cu—In—Ga/Ga/Se, Cu/In/Cu—In—Ga/Ga/Se.

Although the present invention is described with respect to certain preferred embodiments, modifications thereto will be apparent to those skilled in the art.

What is claimed is:

1. A method of forming a Group IBIIIAVIA compound layer on a base comprising:

forming a precursor layer on the base, comprising:

electrodepositing a first film on the base using a first electrodeposition solution, the first film comprising a copper-indium-gallium ternary alloy;

electrodepositing a second film on the first film using a second electrodeposition solution, the second film comprising one of a copper-selenium alloy, an indium-selenium alloy and a gallium-selenium alloy; and electroplating a third film comprising selenium on the second film; and reacting the precursor layer with selenium thereby forming the Group IBIIIAVIA compound layer on the base.

2. The method of claim 1, wherein the molar amount of copper in the first film is less than 20%.

3. The method of claim 2, wherein the second film comprises the copper-selenium alloy and the molar amount of copper in the second film is at least 60%.

4. The method of claim 3, wherein the second electroplating solution includes a Cu salt and a selenious acid.

5. The method of claim 2, wherein the first electrodeposition solution includes copper in the range of 0.005 and 0.5 mol/liters, gallium in the range of 0.01 and 0.7 mol/liters and indium in the range of 0.01 and 0.7 mol/liters.

6. The method of claim 5, wherein the first electrodeposition solution has a pH range of 9-14.

7. The method of claim 6, wherein the first electrodepositing solution includes a complexing agent selected from one of amine and carboxylic organic complexing agent groups.

8. The method of claim 7, wherein the complexing agents comprise at least one of citric acid, tartaric acid, ethylenediamine, triethanolamine, glycine, and ethylenediaminetetraacetic acid.

9. The method of claim 5, wherein the second electrodeposition solution has a pH range of greater than 9.

10. The method of claim 1 wherein electrodepositing the first film comprises, delivering the first electrodeposition solution to the base;

applying a first electrodeposition potential between an anode and the base to grow a first layer of the first film from the first electrodeposition solution on the base, the molar amount of copper (Cu) in the first layer being higher than the molar amount of indium plus gallium (In+Ga);

applying a second electrodeposition potential to grow a second layer of the first film from the first electrodeposition solution on the first layer; the second layer comprising evenly distributed Cu, indium (In) and gallium (Ga) amounts, wherein the second electrodeposition potential is greater than the first electrodeposition potential; and applying a third electrodeposition potential to grow a third layer of the first film from the first electrodeposition solution on the second layer; the molar amount of In+Ga in the third layer being higher than the molar amount of Cu, wherein the third electrodeposition potential is greater than the second electrodeposition potential.

11. The method of claim 10, wherein the molar amount of copper in the first film is less than 20%.

12. The method of claim 11, wherein the second film comprises the copper-selenium alloy and the molar amount of copper in the second film is at least 60%.

13. The method of claim 12, wherein the second electroplating solution includes a Cu salt and a selenious acid.

14. The method of claim 11, wherein the first electrodeposition solution includes copper in the range of 0.005 and 0.5 mol/liters, gallium in the range of 0.01 and 0.7 mol/liters and indium in the range of 0.01 and 0.7 mol/liters.

15. The method of claim 14, wherein the first electrodeposition solution has a pH range of 9-14.

16. The method of claim 15, wherein the first electrodepositing solution includes a complexing agent selected from one of amine and carboxylic organic complexing agent groups.

17. The method of claim 16, wherein the complexing agents comprise at least one of citric acid, tartaric acid, ethylenediamine, triethanolamine, glycine, and ethylenediaminetetraacetic acid.

18. The method of claim 14, wherein the second electrodeposition solution has a pH range of greater than 9.

* * * * *